United States Patent [19]

Antenore

[11] 4,249,674

[45] Feb. 10, 1981

[54] DRY PRODUCT DISPENSER

[76] Inventor: Ronald L. Antenore, 5790 SW. 16th St., Miami, Fla. 33155

[21] Appl. No.: 65,735

[22] Filed: Aug. 10, 1979

[51] Int. Cl.[3] ..... B67D 5/32; B67D 5/54

[52] U.S. Cl. ..... 222/153; 222/196; 222/635

[58] Field of Search ..... 222/129.2, 145, 153, 222/196, 630, 635, 195, 1; 239/325, 327

[56] References Cited

U.S. PATENT DOCUMENTS

| | | | |
|---|---|---|---|
| 1,360,642 | 11/1920 | Irwin | 222/633 |
| 3,305,134 | 2/1967 | Carmichael et al. | 222/635 |
| 3,592,357 | 7/1971 | Welch | 222/635 |

*Primary Examiner*—H. Grant Skaggs

*Attorney, Agent, or Firm*—Shoemaker and Mattare, Ltd.

[57] ABSTRACT

A dry product dispenser uses vibration to move product into a dispensing location. A piston is mounted in the dispenser to be moved by pressure exerted thereon by propellant, and a spring mounted post prevents contact between the propellant and the product until the piston has moved a predetermined distance. Immediately after contact between the propellant and the product, the piston is returned to a repose position in which such propellant-product contact is prevented. The cycle is repeated rapidly as long as an actuating element on the device is activated. Alternative embodiments include child safety features.

23 Claims, 19 Drawing Figures

DRY PRODUCT DISPENSER

BACKGROUND OF THE INVENTION

The present invention relates in general to dispensers, and, more particularly, to dry product dispensers.

There are many proposals for dispensing product, such as dry powder, or the like. Among these proposals are the devices disclosed in U.S. Pat. Nos.: 456,205; 2,358,329; 3,162,332; 2,598,291; 3,625,403; and 3,704,811.

However, all of these devices suffer several disadvantages. None of these devices properly fluidize the dry product during operation, and hence suffer drawbacks related to product clumping, or the like. Clogging and/or "mudding" may occur during the operation of these devices.

In particular, U.S. Pat. No. 3,598,291 uses the principle of channeling the propellant gas through a second container of powder, whereby fluidization picks up the powder. The powder/gas mixture then exits the powder container through a directive nozzle. This design proves to be inadequate in practice for several reasons:

1. No method is given for preventing powder from entering the discharge tube when the container is not in use. Ordinary shipping and handling will cause this tube to fill with powder. When a discharge valve is opened, gas pressure builds in the powder container until the discharge tube clears, or the container bursts. It is noted that all forms of this invention require two containers capable of withstanding full pressure which is expensive. It would not be possible to store the powder in a plastive overcap. The embodiment disclosed in FIG. 6 of this patent does not lend itself to suitable methods of closure for funnell 44 and/or ejection nozzle 48.

2. In the operation of the FIG. 6 embodiment, the gas is brought through the powder in the fluidization process. However, if the can is moved during operation, small amounts of liquid propellant will move into the powder container before vaporizing. Formations of "mud" result, causing clogging of the discharge tube, and hardened, caked powder between the gas outlet and the discharge path, thus preventing future mixing of the gas and powder.

3. The process of fluidization requires a large amount of gas flowing though the powder. The rapid boiling of the liquid propellant to provide this gas chills the propellant, dropping propellant pressure and reducing gas flow. This aggravates the aforementioned problem of "mudding". The continuous flow of gas results in heavy concentration of powder, thereby negating the device for consumer applications.

The assembly disclosed device overcomes these drawbacks and provides an easily and efficiently manufactured dry powder dispensing device.

SUMMARY OF THE INVENTION

The product dispensing device disclosed herein dispenses dry product in an efficient manner with a minimum of clumping or "mudding". The device utilizes a unique vibrator action to be amenable to a wide range of commerical uses. The device enables manufacturers to use standard aerosol equipment and is very inexpensive to manufacture.

The device includes an overcap which is snap-fit over a propellant container and has a product dispensing port defined in the wall thereof. A dish-shaped platform is pop-fit in the cap and product is stored on the platform.

A product dispensing mechanism is mounted on the platform at a position to receive product and includes a hollow cylindrical housing having a piston movably held therein. A spring has a post thereon and is retained at one end of the housing by a spring retainer while the piston is located at the other end of the housing. The piston has a fluid passage defined therethrough, and the post is located to movably occlude that passage. The passage connects with the cap dispensing opening and is in fluid communication with a product dispensing path. The housing has a pin and a propellant receiving stem thereon. A snubber resists separation of the post and the piston.

Actuation of the device occurs by movement of a cap to actuate the propellant container. Propellant flows into the housing and the piston and spring mounted post move forward in tandem. The spring on which the post is mounted contacts the spring retainer after a predetermined amount of movement.

Contact between the spring and the spring retainer causes the post to unblock the piston passage, thereby allowing propellant to pass through that passage. The propellant intersects product on the way out of the device and thus entrains that product therein. The entrained product is ejected from the cap.

Movement of the piston with respect to the housing is resisted by the snubber and only occurs when pressure inside the housing produces a force on the piston which exceeds the resisting force of the snubber. Unblocking of the piston passage vents the propellant, thereby releasing the force against the snubber. The snubber thus returns the piston to a repose position whereat the cycle is repeated.

The sequence is continually and rapidly repeated as long as the cap actuation element is operated. The above-discussed cyclic operation occurs very rapidly, at about 100 cycles per second in one embodiment, and sets up a vibration which moves the dry product along the dish-shaped platform toward, and into, the piston. At rest, the piston slots are closed so that no powder may escape. Further offset slots in the cylinder housing are used to produce the path through which the dry product moves into the piston for dispensing. The offset nature of the slots closes the path into the piston when the piston is out of product dispensing position.

The device disclosed herein thus has significant advantages over prior art devices:

1. The device contains the product separately in the overcap rather than mixed with the propellant.
2. The device utilizes a vibrator to move the powder.
3. The vibrator of the present device is powered by a gaseous propellant.
4. The device uses the exhaust of the vibrator to suction powder into the gas stream rather than blowing through the powder. This prevents any liquid propellant which might come through the vibrator from mixing with the powder.
5. The devices uses slots to close off the powder when not in use, thus preventing leakage.

Other embodiments of the device include child safety features and various snubbers.

OBJECTS OF THE INVENTION

It is, therefore, a main object of the present invention to dispense dry product without undue clogging or "mudding".

It is another object of the present invention to use a vibrator action to move product in a dry product dispenser.

It is still another object of the present invention to dispense dry product without requiring movement of propellant gas through the dry product storage area.

It is yet another object of the present invention to provide an easily and efficiently manufactured dry product dispenser.

It is still another object of the present invention to provide a dry product dispenser which is not susceptible to leakage during storage.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
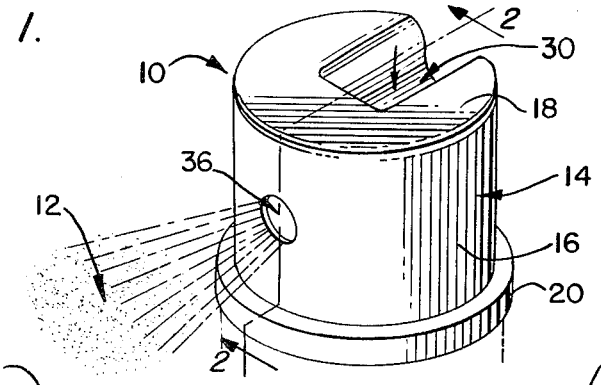
FIG. 1 is a perspective of a cap utilizing the device embodying the teachings of the present invention.
Figure 2:
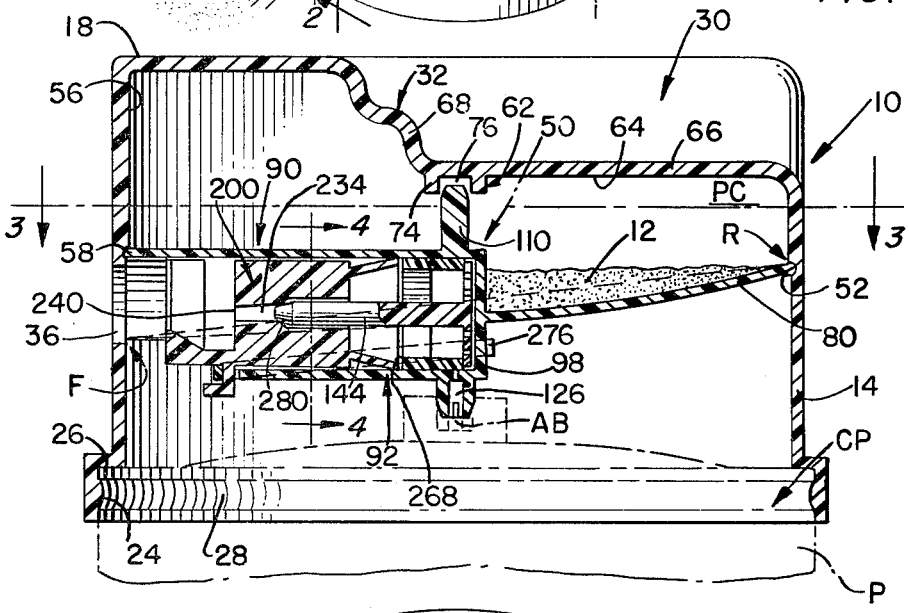
FIG. 2 is an elevation view taken along line 2—2 of FIG. 1.

Shown in FIG. 1 is an overcap 10 used for dispensing material 12, such as powder or the like. The cap 10 includes a tubular body 14 having a side wall 16 and a top 18 and a peripheral skirt 20 circumferentially surrounding that side wall on the lower end thereof. The skirt is sized to snugly accommodate propellant container P, and as shown in FIG. 2, may have a bead protrusion 24 positioned on the inner peripheral surface 26 thereof to snap into a corresponding collar 28 on the propellant container. In this manner, a snap fit is established between the cap 10 and the container P. As best shown in FIG. 1, a finger well 30 is defined in the overcap 10 by deforming the top 18 into a semi-cylindrical shape. The top 18 is further deformed to define a stepped surface 32 to permit inward flexure of the top cap at or near the finger well for push-button purpose to be described hereinbelow. A product dispensing outlet 36 is defined in the cap side wall, and is preferably circular as shown in FIG. 1, but can be other shapes as well.

Figures 4, 5:
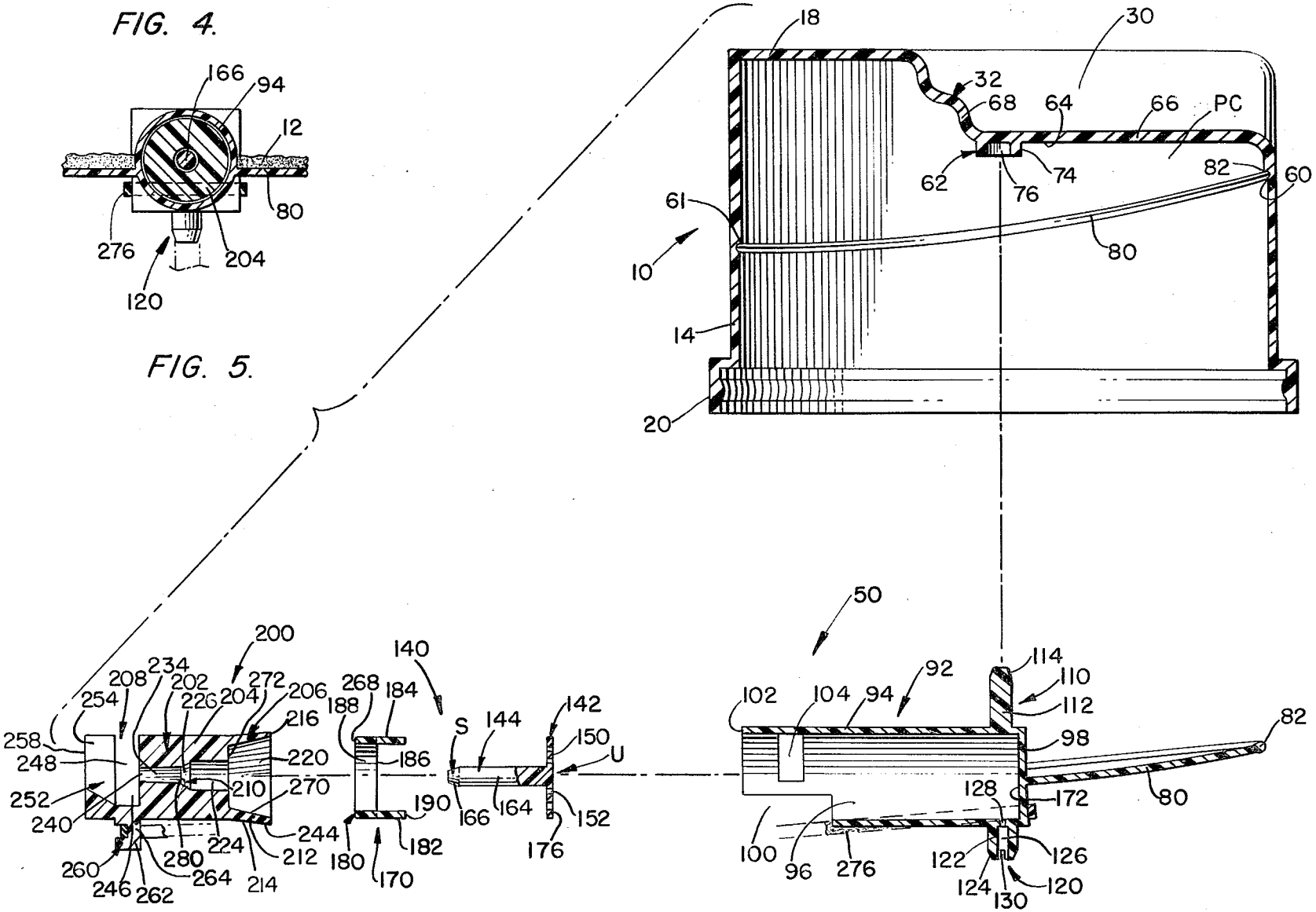
FIG. 4 is a view taken along line 4—4 of FIG. 2.
FIG. 5 is an exploded view showing the cap and the dispensing mechanism embodying the teachings of the present invention.

An actuator mechanism 50 is mounted inside the cap 10 and is best shown in FIGS. 2 and 5 to which attention is now directed. A circumferential channel 52 is defined in inner surface 56 of the cap side wall and includes an arcuate portion 58 and an undercut region 60 on the bottom rim thereof. A ledge 61 is also defined for a purpose to be discussed below. The channel is canted with respect to a plane containing top 18 to form an angle with that plane as shown in FIG. 2. The preferred angulation of the channel is 7 to 10 degrees. The channel thus has a portion F located subjacent the outlet 36 which is nearer the cap bottom CP than is that portion of the channel located on the diametric opposite side of the cap and identified by the reference indicator R in FIG. 2.

A tubular pin locator 62 is mounted on inner surface 64 of top 18 near the intersection of finger well bottom 66 and stepped side wall 68. The pin locator is depressed toward the bottom CP of the cap when the finger well is depressed inwardly of the cap. The pin locator includes a segmented tubular wall 74 and a blind-ended bore 76.

Figure 3:
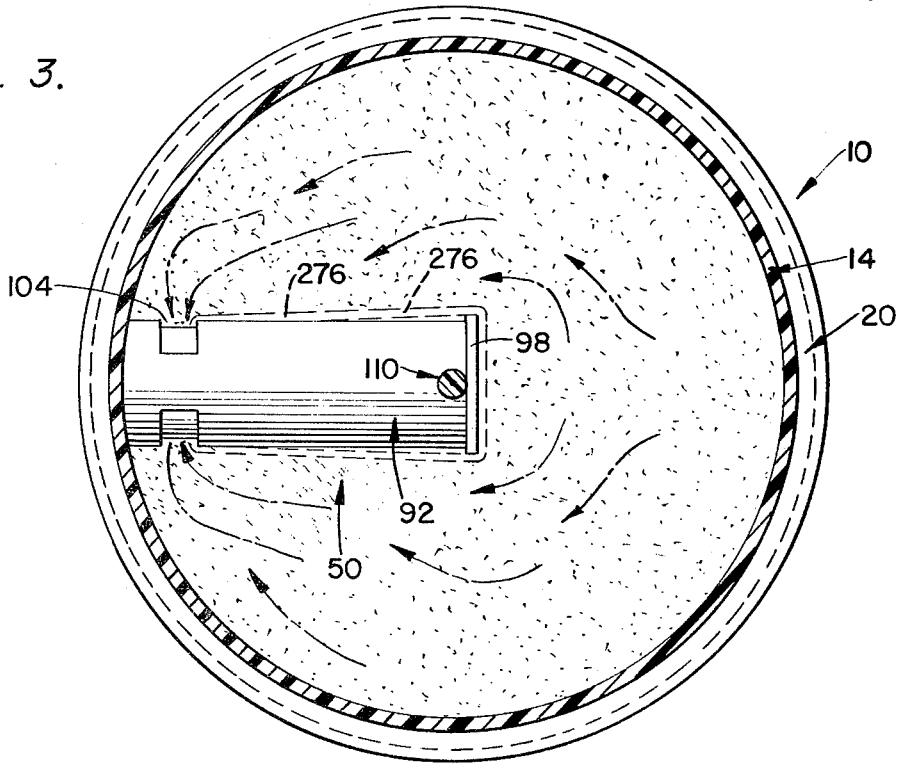
FIG. 3 is a plan view taken along line 3—3 of FIG. 2.

The actuator mechanism 50 includes a circular dish-shaped platform 80 which is mounted on the cap via the channel 52. As best shown in FIG. 5, the platform 80 has a bead 82 on the outer peripheral rim thereof. The platform 80 is pop-fit into the channel 52 and is therefore downwardly disposed from the channel rear portion R toward the dispensing outlet 36 as best shown in FIG. 3. The platform is arcuate and has arcuate peripheral edges for easy, yet secure positioning in the channel 52.

As shown in FIG. 2, a product dispensing mechanism 90 is supported within the cap 10 by the platform 80. As best shown in FIG. 5, the dispensing mechanism includes a modified cylindrical housing 92 having a wall 94 and a blind-ended bore 96 defined therein by the wall 94 and a housing base 98. A notch 100 is defined in the forward end 102 of the wall which is remote from the base 98. A pair of elongate, rectangular slots 104 (one shown in FIG. 5) are defined in the housing wall near the forward end 102 to be on chordally opposite sides of the housing and to be spaced from the notch 100.

A pin 110 is integrally mounted on the housing wall to extend radially outward from the wall and is located near the base 98. The pin has a cylindrical body 112 and a frusto-conical tip 114. The purpose of the pin will be discussed below, and the tapered nature of the tip prevents clogging of the bore 76 during operation of the device.

The housing is integrally attached to the platform 80 to be mounted thereon and supported thereby within the cap 10. As indicated in FIGS. 2 and 5, the housing is oriented so that a plane containing the longitudinal centerline thereof is essentially in spaced parallelism with the plane containing top 18 so that the housing is essentially horizontally positioned. Thus, the housing is tilted with respect to the platform 80.

As shown in FIG. 5, the base 98 of the housing is tapered in thickness so that the thinnest portion thereof is located near the pin 110. The purpose of this tapering will also be evident from the ensuing discussion.

A gas inlet stem 120 is integrally mounted on the housing wall near the base 98 to extend radially outward from the housing. The stem is tubular with wall 122 and frusto-conical tip 124 surrounding and defining a bore 126. A gas inlet port 128 is defined through the wall 94 to fluidly connect the bore 126 with the bore 96. Slots 130 are defined in the stem 120 through which propellant passes into the bore 126. Preferably, the slots 130 are oriented at essentially right angles to the longitudinal centerline of the bore 126.

As shown in FIG. 2, when the platform mounted housing is in place, the pin 10 is slidably received in the bore 76 of the pin locator 62, and the gas stem 120 received in actuator button AB of the propellant container P. Downward movement of the finger well lower wall 66 forces the housing 92 downwardly and the gas stem is forced against the propellant actuator stem to thereby actuate the propellant container. Released propellant flows through the bore 126 and into the bore 96 via the gas inlet port 128. The stepped configuration of the wall 32 permits flexing and return of the cap during the afore-discussed operation.

Figure 6:
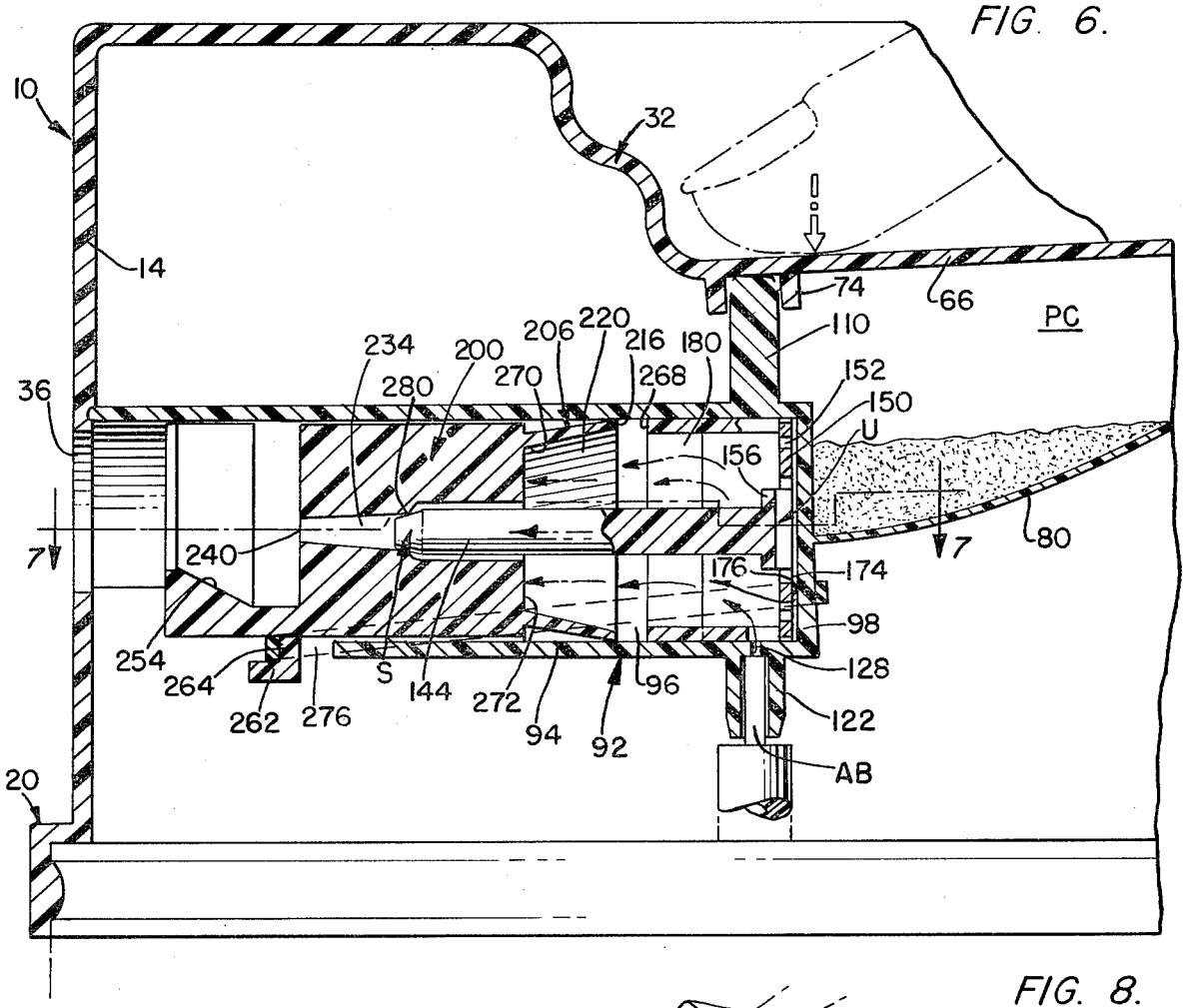
FIG. 6 is a view showing the dispensing device embodying the teachings of the present invention in a first position wherein propellant is initially located in the device.
Figure 8:
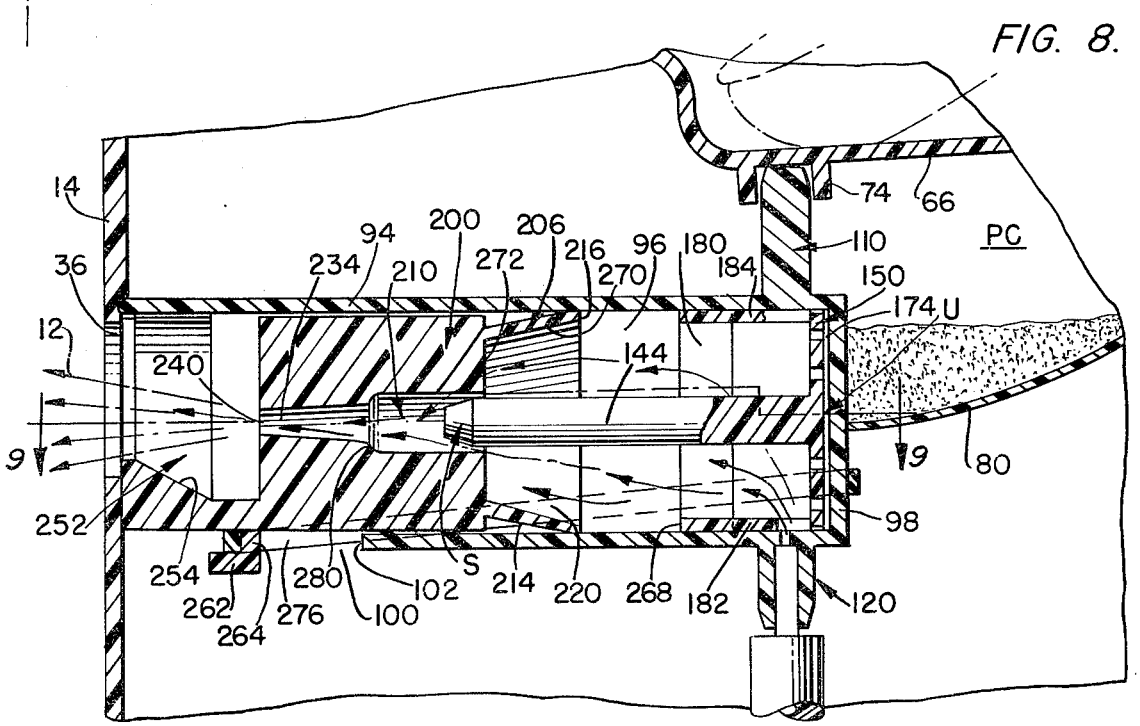
FIG. 8 is a view of the device embodying the teachings of the present invention wherein the propellant in the device is just permitted to move through that device into contact with the dry product.
Figure 7:
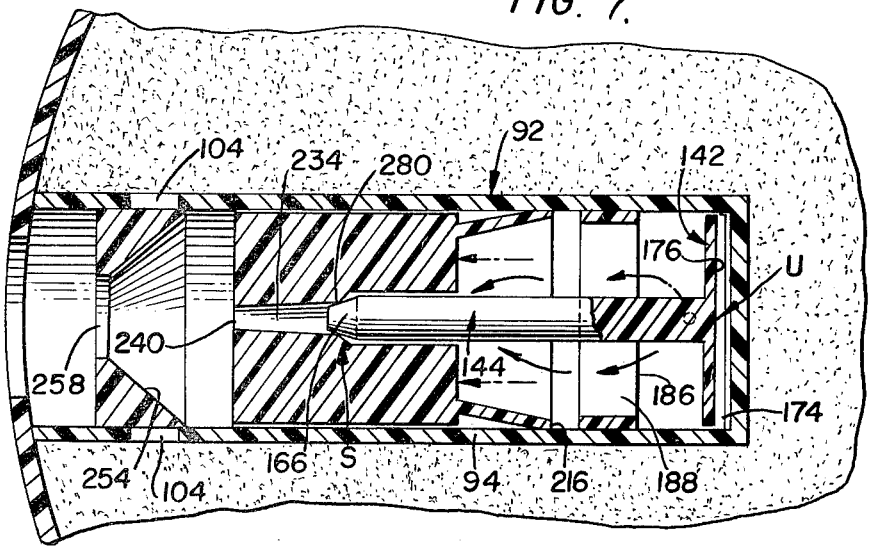
FIG. 7 is a view taken along line 7—7 of FIG. 6.
Figure 10:
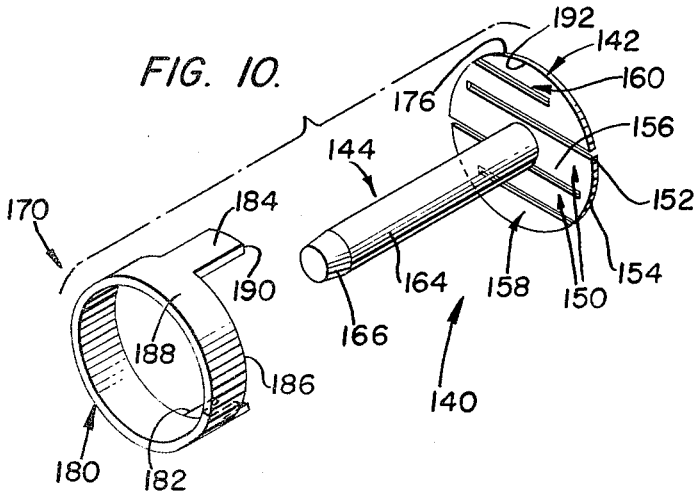
FIG. 10 is an exploded perspective of a spring and spring retainer used in the device embodying the teachings of the present invention.

A gas flow controller 140 is mounted within the bore 96 and includes a disc-shaped spring base 142 and a projecting post 144 integrally mounted at the base thereof on the bse 142. As best shown in FIG. 10, the base 142 has a plurality of leaves 150 defined therein by slits 152 which are essentially parallel with each other and which extend from outer periphery 154 for a distance across the disc. The post 144 is mounted on a center segment 156 and outer segments 158 and 160 are restrained as will be discussed below. The spring base leaves are flexible and are flexibly coupled together so that the center segment with the post affixed thereto moves relative to the outer segments. This movement is best shown in FIGS. 6, 7 and 8, and the function and operation thereof will be discussed below.

The post 144 includes a cylindrical body 164 and a frusto-conical tip 166 on the end thereof which is remote from the central segment mounted base of the post.

A spring retainer mechanism 170 is friction fit within the housing bore 96 to maintain the spring base near inner surface 172 of the base 98. However, it is noted that there is a gap 174 defined between the base rear surface 176 and inner surface 172 of the base 98.

As best shown in FIGS. 5 and 10, the spring retainer includes an annular ring 180 having an outer diameter sufficient to snugly retain the mechanism 170 in position within the bore 96. A pair of prongs 182 and 184 projects longitudinally of the ring outwardly from ring base 186. The prongs are transversely curved to match the curvature of the ring and to be flush with ring outer surface 188. The prongs are co-extensive and have heels 190 which abut upper surface 192 of the outer segments 158 and 160 of the spring disc to maintain that base securely in position. The friction fit of the retainer 170 within the bore 96 maintains that mechanism in position, thereby fixing the outer segments 158 and 160 of the spring in position while the center segment 156 is permitted to flex.

Propellant entering the bore 96 via gas inlet 128 moves into the gap 174 defined between the spring base and the housing base and exerts a pressure on the spring base urging the spring base forwardly within the bore 96 away from the base 98.

It is here noted that the terms "forward" and "rear" are taken with respect to propellant flow direction. That is, for example, the base 98 is located in the "rear" while the outlet 36 is located "forward" of the base.

Figure 18:
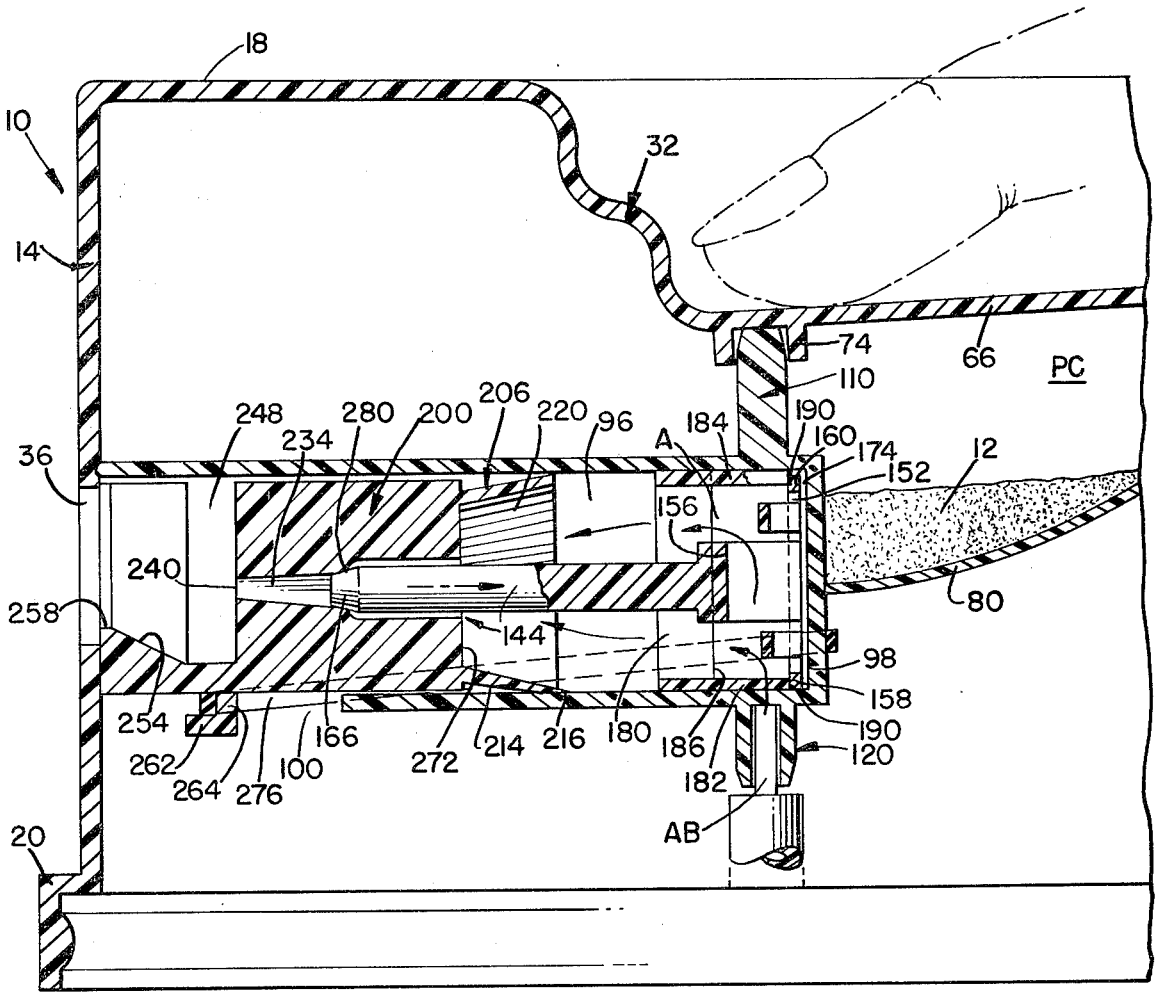
FIG. 18 is a view of the dispensing device embodying the teachings of the present invention just prior to unblocking of a passage connecting the propellant with the dry product.

The spring, in response to this aforediscussed pressure exerted thereon by the propellant located in gap 174 between the base 98 and the spring disc base, moves forward, however, the outer segments of the spring disc are retained fixed in position by the prongs 182 and 184 of the spring retainer 170. Thus, the center segment 156 flexes foward away from the base 98 from the FIG. 8 position into the FIG. 6 position. This flexure is also shown in FIG. 18 where the propellant movement is indicated by arrows A. The forward movement of the spring center segment is stopped by the lower rim 186 of the spring retainer ring 180. The center segment contacts this rim as best shown in FIG. 18, and further forward motion of the center segment and post 144 is prevented as the ring is securely held in position within the cylindrical housing 92. The size of the prongs and spring constant of the spring can be adjusted to set the desired response and travel of the post 144.

A piston or nozzle mechanism 200 is received within the bore 96 at the forward end thereof as shown in FIG. 2 to be slidable therein. As best shown in FIG. 5, the nozzle mechanism includes a housing 202 having a cylindrical body section 204 with a cup section 206 on one end thereof and a venturi defining nozzle 208 on the other end thereof. A stepped passage defining bore 210 is defined through the body portion to extend longitudinally of the mechanism.

The cup section 206 is defined by a wall 212 which is integrally connected at one end thereof to the body section 204 and flares outwardly and rearwardly therefrom. The cup wall has an outer surface 214 which contacts the inner surface of the bore 96 in a fluid flow preventing manner near rim 216 of that cup, and a bore 220 defined by that wall. The bore 220 is in fluid communication with the bore 96 to receive propellant entering that bore 96 via the gas inlet port 128 as indicated in FIG. 18. The spring retainer prongs can be oriented to be spaced from the port 128, or one of the prongs can have a port means defined therein to permit propellant to move past the prong into the bore 96 and forward of the spring base.

The stepped passage 210 includes a rear section 224, a piston seat section 226 which is connected at the rear end thereof to the forward end of the rear section and which is forwardly convergent. A forward section 234 is connected at a rear end thereof to the forward end of the piston seat passage and is slightly forwardly convergent.

Figure 9:
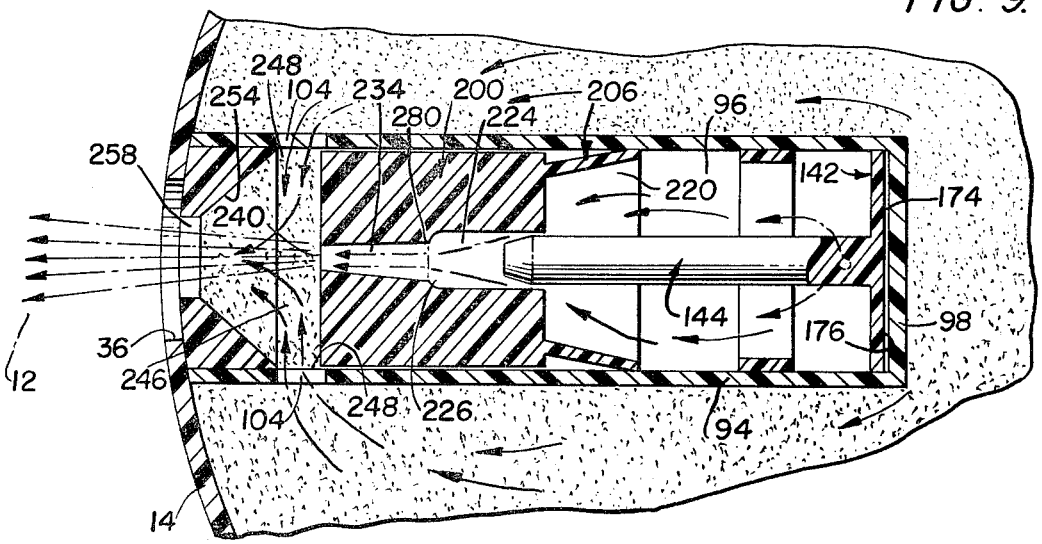
FIG. 9 is a view taken along line 9—9 of FIG. 8.

The stepped passage sections are fluidly connected with each other and with the bores 220 and 96 so that propellant can move through the stepped passage from the bore 96 as indicated in FIG. 9. The forward section 234 has an outlet port 240 defined at the forwardmost end of that section to be in fluid communication with outlet port 36 of the cap 10.

A product holding chamber 246 is defined in front of the outlet port 240 and includes a pair of elongate slots 248 (one shown in FIG. 5) defined in the housing of the nozzle mechanism. The slots 248 are in fluid communication with the holding chamber so that product will enter that chamber via the slots 248 and be in fluid communication with the outlet port 240. The slots 248 thus provide a type of fluid communication between the propellant passage and the product held on the platform 80.

A venturi or converging section 252 is located forwardly, that is upstream, of the holding chamber, which is upstream of the outlet nozzle. The converging section has a bore 254 defined therein which is in fluid communication with the outlet port 240 and with the powder outlet section 36 (see FIG. 1) of the cap. The venturi section has an outlet port 258 which is in fluid communication with the cap outlet 36 when product is dispensed from the device as shown in FIG. 9. Thus, there is a fluid path defined from the port 128 to the port 30 of the cap, which path passes through a product holding chamber into which product to be dispensed flows via the slots 248. The function and operation of the nozzle mechanism 200 will be discussed below.

A mounting bracket 260 is integrally mounted on the piston or nozzle mechanism and extends radially outwardly therefrom. The bracket includes a base 262 and a web 264 and is received in notch 100 when the nozzle mechanism is positioned within the bore 96 of the housing 92 as shown in FIG. 2.

The nozzle mechanism is slidably received within the bore 96 and moves from a rearmost position with cup rear end 216 abutting the ring top rim 268 as shown in FIG. 2 to a forwardmost position with those rims spaced apart as shown in FIG. 8.

The piston moves under the influence of the pressure exerted thereon by the propellant inducted into the bore 96. Movement and operation of the device is best shown in FIGS. 6–9 and 17 and 18. As shown in FIG. 6, this propellant exerts a forward biasing pressure on inner surface 270 of the cup section and on rear surface 272 of the body section tending to force the nozzle mechanism forward within the bore 96. A snubber 276, such as an elastic band, or the like, is mounted on the bracket 260 and the tapered base 98 to resist this forward bias, and pressure within the bore 96 continuously builds up as propellant flows thereinto. The snubber thus resists relative movement between the piston 200 and the cylinder 92.

When the pressure within the bore 96 reaches a level sufficient so that the forward biasing force exerted on the nozzle mechanism is greater than the rearwardly biasing force exerted thereon by the snubber, that nozzle mechanism moves forward from the FIG. 2 position toward the FIG. 6 position.

As shown in FIGS. 2 and 7, the post 144 extends into the stepped passage 210 with the tip 166 seated against the shoulder 280 defined at the intersection of the rear passage section and the covering throat or seat section 226, and acts as a stopper or gagger for this passage. This seating location is identified in FIG. 7 by the reference indicator S.

It is seen in FIG. 7 that the propellant exerts pressure on all surfaces located within the bore 96. By performing a force balance on the elements located within this bore, it is seen that forward pressure is balanced by rearward pressure on all elements except the area on the spring base located immediately behind the post 144 and corresponding to the area included in the seating area S. This area is unbalanced due to the closure of the passage 234 via the engagement of the post tip 166 in the seating section. This unbalanced area is indicated in FIG. 7 by the reference indicator U.

Figure 19:
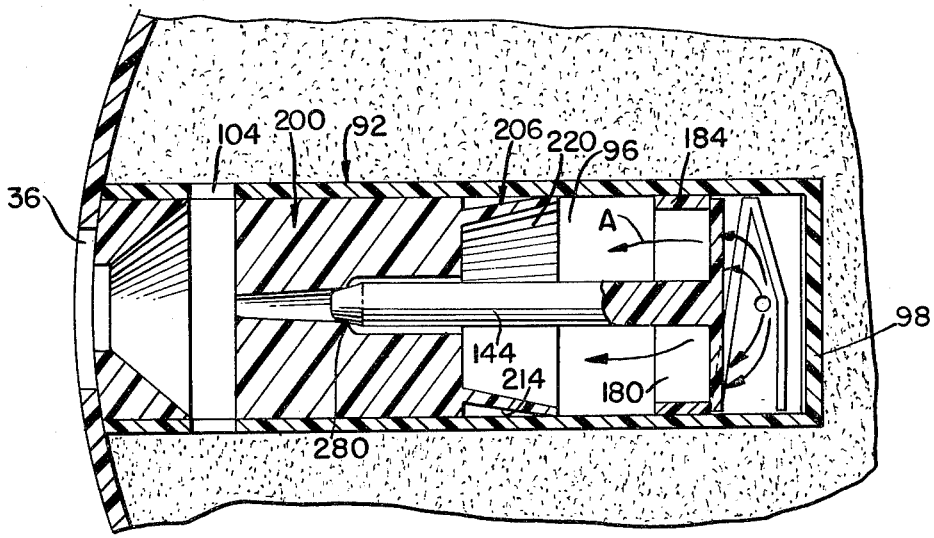
FIG. 19 is a view taken along line 19—19 of FIG. 18.

It can thus be seen that when propellant enters the bore 96, there will be a net force exerted on the gas flow controller 140 by the propellant located in gap 174, and, more specifically, by the propellant located in the gap 174 adjacent the area U. This net force tends to move the flow controller 140 forward, and this forward movement matches the forward movement of the piston or nozzle mechanism 200 so that the post chases the nozzle mechanism and these two elements move in tandem as indicated in FIGS. 7 and 8, and 19.

This tandem forward movement is interrupted when the spring center section 156 contacts the rim 186 of the spring retainer as above-discussed. During the tandem movement, the passage 234 is occluded by the post as shown in FIGS. 6 and 7. However, the nozzle section continues to move forward even after the post is stopped. Thus, the passage 234 is opened as shown in FIG. 8 and propellant bypasses the post and flows into the passage 234. The post is returned to the repose position as shown in FIG. 9 by the spring, and propellant passes through the holding chamber and into the nozzle converging section 252, then out of the outlet ports 240, 258 and 36. As the propellant passes through the holding chamber, any product located therein is fluidized and carried along with the propellant out of the outlet port as shown in FIGS. 8 and 9.

The slots 248 and 104 are positioned so that those slots are offset from each other when the nozzle mechanism is in the FIG. 2 repose position, but are brought into alignment during the forward movement of the nozzle mechanism under the influence of the propellant.

As shown in FIG. 5, the platform 80 has a slope from the outer rim thereof downwardly toward the center thereof whereat the actuator mechanism 50 is located. Product 12 is held on top of the platform and thus has a gravity induced gradient toward the actuator mechanism as best indicated by the arrows in FIG. 3. The mechanism 50 is located so that the position whereat the slots 248 and 104 are aligned is at the point of maximum product confluence.

As indicated in FIGS. 8 and 9, when the spring contacts the spring retainer and stops the forward motion of the post 144, the continued forward motion of the nozzle mechanism in effect vents the chamber formed in the bore 96, and the propellant in this chamber flows out of the chamber thereby releasing the forward biasing pressure exerted on the nozzle assembly. With the forward biasing pressure released, the rearward bias of the snubber 276 causes the nozzle mechanism to be moved backward to and returned to the FIG. 2 repose position.

In the repose position, propellant will again fill the chamber to a pressure sufficient to move the nozzle assembly forward and thereby repeat the just-described process.

The forward and return movements of the nozzle assembly jolt the housing and cause a shock to be exerted on the actuator mechanism housing which transmits a shock to the platform, which, in turn, transfers a shock to the product 12. These shocks cause vibration in the product to assist movement of that product toward the mechanism 50.

The process is repeated as long as the finger well is depressed to permit propellant to be introduced into the chamber defined in the bore 96 by the housing 92 and the nozzle mechanism 200. Product, such as dry powder, is delivered intermittently in a pulsating manner and is entrained in the escaping propellant. Rapid and repeated pulses of product entrained propellant are delivered while the finger well remains depressed. It is noted that all of the product is stored in the overcap 10.

Figure 11:
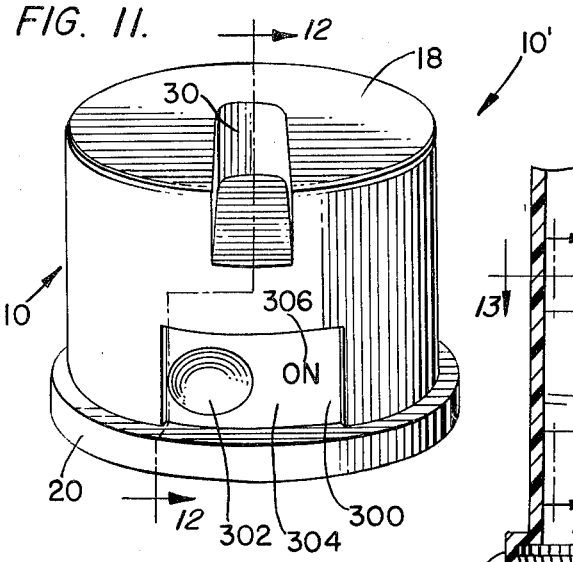
FIG. 11 is a perspective of an embodiment of the present invention which includes a child safety feature.
Figure 12:
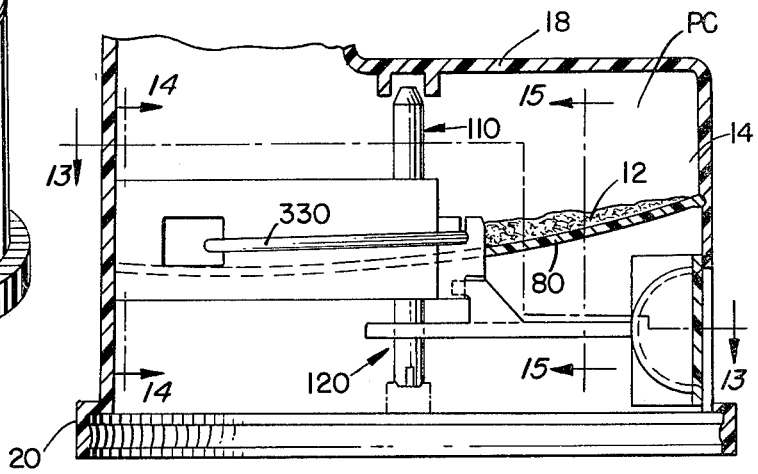
FIG. 12 is a view taken along line 12—12 of FIG. 11.

Two alternative embodiments of the dispensing cap 10 are shown in FIGS. 11–17. FIG. 11 shows a cap 10' with a child-safety feature. The cap 10' includes a cutout 300 in the overcap 10' beneath the finger well 30. A finger size depression 302 is defined in a sliding plate 304 which is mounted on the cap 10'. Indicia 306 indicating the mode of operation can also be included on the plate 304.

A swing arm 310 is attached at one end thereof to the plate 304 and extends inwardly of the cap. The swing arm pinch fits with the stem 120 and thus defines a vertically extending portion 312 located on the other end of the swing arm. The portion 312 is located vertically beneath the pin 110. A shaped slot defining flange 316 is mounted on the housing to receive the portion 312. The slot has a first area 320 and a second area 322, with the first area being the larger of the two areas.

Movement of the swing arm 310 into an "on" position orients the portion 312 in the first area 320 so that depression of the finger well will move the housing 92 downwardly so the propellant valve can be actuated. However, with the swing arm 310 in an "off" position, the portion 312 is located in the second area 322 and downward movement of the housing 92 is prevented by contact between the slot defining bracket and the portion 312 so that the propellant valve cannot be actuated.

The restricted travel prevents the device from being actuated during shipment or by accidental use, such as by a child. It is noted that the device with the child safety switch may be assembled separately and onto a product filled overcap as a unit, thereby eliminating complicated assembly by a commercial product seller.

Figure 13:
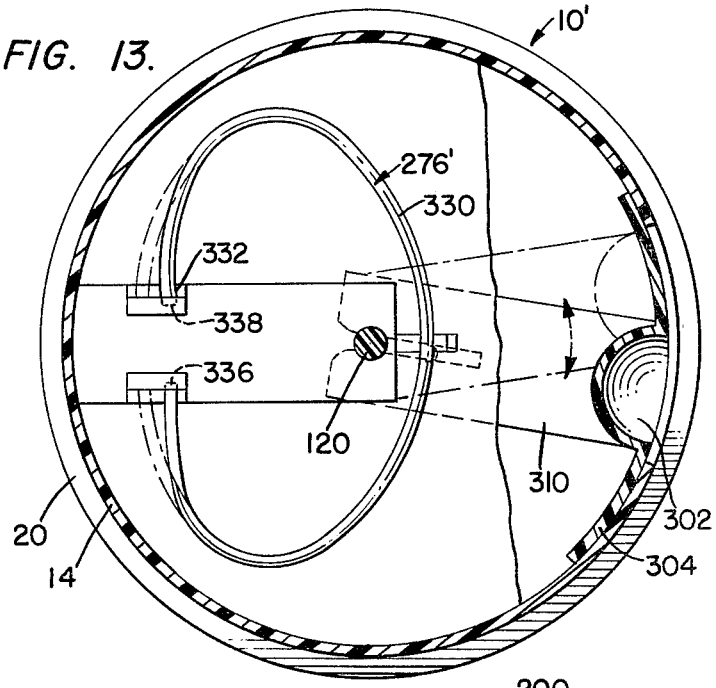
FIG. 13 is a view taken along line 13—13 of FIG. 12.
Figure 14:
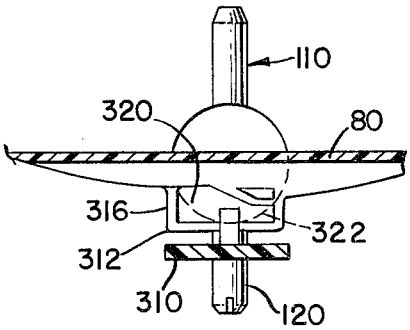
FIG. 14 is a view taken along line 14—14 of FIG. 12.

A further modification to the device can be used with or without the above-discussed child safety feature, and is best shown in FIG. 13. The snubber 276' includes a steel spring 330. Operation of the device with snubber 276' is identical to the above-discussed operation using snubber 276. The steel spring 330 is elliptical and is secured to the housing in a notch 332 molded into the cylinder housing near the back thereof. Two small indentations 336 and 338 in the sides of the nozzle assembly body receive the front ends of the spring 330. The spring is biased to urge the nozzle assembly back into the FIG. 2 repose position.

The spring 330 is located inside the powder chamber PC as opposed to the elastic band in snubber 276 which is located beneath the powder containing platform 80. This powder chamber location of the spring 330 facilitates the transmission of vibration to the powder, or product mass. The powder slots in the nozzle assembly and housing in the cap 10 using the steel spring are wider than in the embodiment using the elastic band to allow for travel of the spring ends.

Figure 15:
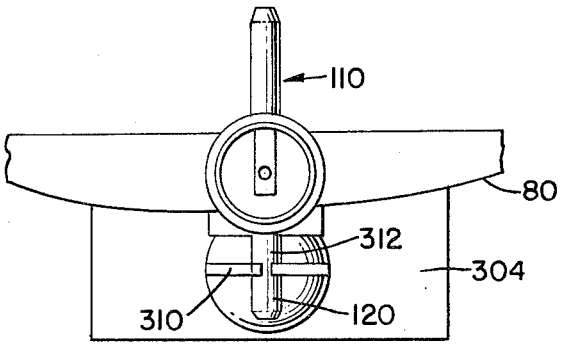
FIG. 15 is a view taken along line 15—15 of FIG. 12.
Figure 16:
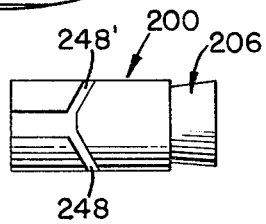
FIG. 16 is one view of a piston used in the FIG. 11 embodiment.
Figure 17:
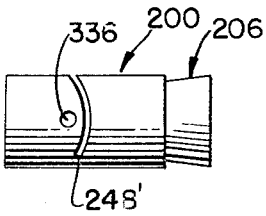
FIG. 17 is another view of a piston used in the FIG. 11 embodiment.

The piston, or nozzle assembly, is modified for the steel band by removing the bracket used to hold the elastic band, addition of indentations 336 and 338, and the like. As shown in FIGS. 15 and 16, the slots 248' are also slightly modified to accommodate the indentations.

In the preferred embodiment, the nozzle assembly travels approximately 0.125 inches from the repose position to the fully actuated position (i.e., one-half a cycle), and the spring mounted post 144 travels about 0.125 inches before being stopped by contact between the center section of the base and the rim 186 of the spring retainer ring.

It is noted that overcap 10 or 10' can be a commercially available cap which has been modified for use in the present device. Such modification presents many advantages to manufacturers and the like.

The finger well actuation element can be replaced by a button held in place on the cap by a button nut. In this case, the cap and the button would be molded as one piece.

The stem 120 of the actuator 50 mates with standard aerosol valves (without dip tube) such as those manufactured by Newman-Green, Inc. The ring portion of the spring retainer is press fit in the bore 96. The center rod 144 of the spring unit extends outwardly through the ring portion of the spring retainer. The spring unit and spring retainer can be molded as one piece. An O-ring or a flange can be placed around the head of the piston 200, and it is also possible to mold the piston and nozzle mechanism as one.

In one embodiment, product is about 0.3 inches in depth on the platform and the propellant container is a 202×214 aerosol can containing 1.5 ounces of A70 hydrocarbon propellant. Preferably, the platform 80 is held at a 7 to 10 degree angle relative to the horizontal for proper powder movement. The channel 58 defines an internal ledge 350 upon which the platform and actuator mechanism 50 rest. In one embodiment, the ledge extends inwardly 0.080 inches, but may be 0.045 inches over the outlet port if desired, and up to 0.010 inches for the remaining inside wall. This ledge serves as a stop for the insertion of the actuator mechanism and platform. Additionally, the ledge which surrounds the outlet port 36 functions as a seal against powder leakage. The front of the actuator mechanism is held immobile at the junction of the platform, the cylinder housing 92 and the overcap 10. The rear section of the actuator mechanism 50 is moved to actuate the propellant container. The top front of the actuator mechanism 102 therefore moves inwardly of the cap during operation of the device; this travel can be 0.030 inches in some embodiments. The extended ledge in this area prevents open communication between the product storage area and the outlet port. A slight undercut beneath the ledge permits easy pop-fit of the platform into position in the cap.

The finger well functions as the "push button" while maintaining the integrity of the powder storage area and serving to make the discharged spray directional. The corrugated side walls permit the bottom of the well to flex downward while allowing the top of the overcap to remain rigid. This rigidity prevents accidental discharge and is necessary for shipment and storage. Under the finger well and centrally located relative to the overcap is the pin locator. This molding loosely receives the vibrator pin and serves to align the actuator during assembly and prevent side-to-side rotation during use. It is important that this pin locator not totally encase the vibrator pin to prevent buildup of product between the pin and locator. An intermittently gapped circular wall will suffice.

The outlet port is a circular cutout in the wall of the overcap. The only requirement for this port is that it must be of a diameter great enough so that it does not interfere with the product spray as it exits the vibrator.

The overcap is attached to the propellant can by means of the lower section which is designed to pop-fit over the top outside rim of the propellant can. Four small protrusions can be used to replace the bead shown in FIG. 1 to provide a positive lock over this rim. However, since a tight and permanent lock may be desirous to prevent separation of the overcap from the can ingredient labeling, an outside attachment may be most preferred. This method allows automatic capping equipment to press the overcap onto the can by the lower section or rim, permitting thin walls in the rest of the overcap. Inside locking overcaps require stronger walls as the mounting force must be applied to the top of the overcap.

As with other conventional overcaps, the style may be varied or sculptured to allow individual manufacturers to adapt a design characteristic of their product. Manufacturers that currently mold their own overcap may continue to do so without major change in equipment.

The platform surrounds the actuator mechanism housing 92 and is constructed to hold the stem and pin along the vertical axis. The bead on the outside edge of this platform provides extra rigidity. This outside edge will snap fit to the undercut of the overcap. The remaining surface of the platform or dish should be sufficiently thin to permit the downward flexing needed to activate the valve. The highest point of the dish should be the edge directly behind the cylinder housing with all surfaces sloping toward the two slots in the cylinder housing wall. The stem located at the rear of a cylinder mates with the valve in a propellant can and should extend, in one embodiment, approximately 0.150 inches beneath the cylinder of which 0.100 inches will remain seated in the valve at all times, with the remaining 0.050 inches entering the valve upon activation. The slits defined in the stem extend upwardly from the base of the stem and allow the gas from the can to enter the stem. These slits, lying in a plane perpendicular to the cylinder, serve to begin the breakup of any liquid propellant which might enter the stem, and also allow the stem greater flexibility. The bottom of the stem may be slightly conical to permit proper mating with the valve during assembly.

The tip 114 of the pin 110 is slightly conical in order to permit easier seating during assembly through a wider range of assembly tolerances. Its height must be determined from the overcap style.

Slight undercutting of base 98 insures a rubber band will not creep downward but remain underneath the dish. Also, the thickness of the base may extend outward at least 0.050 inches beyond the outside diameter of the cylinder. This prevents the elastic from contacting the sides of the cylinder which would reduce the liveliness of the band.

The gas inlet 128 located in the cylinder wall above the stem 27 regulates the amount of gas entering the cylinder, and also aids in the breakup of any liquid propellant droplets which may pass upward through the stem. If this hole is too small (less than about 0.015 inches), the vibrator will run at a speed determined by this orifice. If the diameter is too large (greater than 0.20 inches), the vibrator will work at a speed determined by other factors, such as friction between the piston seal and cylinder, seal leakage, elastic band strength, density of powder, or the like. However, too large a diameter allows too much gas to escape, which chills the propellant and drops the gas pressure. A preferred orifice diameter is 0.025 inches.

Diameter of the cylinder bore 96 determines the force with which the piston 90 moves. This force is required to move the piston 90 through the binding, clogging effects of the powder and is related to the square of the radius of the bore 96.

The slots 104 located at the front of the cylinder allow powder to move into the gas stream. The width of the slots 104 must be less than the length (in the fluid flow direction) of the venturi section 252 of the piston to facilitate complete closure of these slots when the unit is not in use. Although their position is determined primarily by the piston design, they should be kept as far forward as possible so that the powder is kept from any piston seal and travels the least distance to the outlet port.

In one embodiment, the front lower section of the cylinder beneath the dish 80 is cut away to allow the snubber band 276 access to the piston 90. This cutout section extends rearward past the slots 104 so that powder which becomes caught between the piston and cylinder does not accumulate, but may fall through the cutout section.

In the preferred embodiment, the front end of the cylinder 92 is curved in the horizontal plane to permit the most precise fit between it and the curved wall of the overcap which can have a radius of approximately 1.0 inch.

The spring 140 and spring retainer 170 are molded as one. In a preferred embodiment, the retainer section is composed of a short cylinder of a diameter 0.003 inches—0.005 inches greater than the diameter of the cylinder bore 96. The two extensions 182 and 184 are about 0.125 inches in length and support the segmented disc 142. The length of these extensions 182, 184 determine maximum spring extension, and hence, maximum piston stroke. The segmented disc provides the spring action. Each segment 150 provides some flex with maximum bending occurring at the disc edges where the segments are joined. The thickness of this disc along with the length of the segments determine the strength of the spring. The diameter of the center post 144 where it seals against the piston determines the maximum holding force which will be exerted in pushing the spring forward according to the area circumscribed by contact point S. Reducing the diameter of this post permits a better seal with the piston, but necessitates a weaker spring. The conical tip facilitates proper seating in the piston.

The piston with the molded seal slides freely into the cylinder bore 96. The outer diameter of the retainer, on one embodiment, is of a diameter approximately 0.005 inches greater than the diameter of bore 96 and the ring section is as thin as possible to permit it to conform to the cylinder walls while maintaining a positive contact. Gas pressure behind this seal will tend to expand and hold it against the walls also.

The center passage through the piston performs three functions. The size of the port into the venturi section regulates, to some extent, the pattern of the powder stream. Smaller diameters lengthen the burst of gas which exits the vibrator and promotes a steadier, more uniform flow. Larger diameters enhance the burst effect and should he able to move greater amounts of powder per vibrator stroke. Directly behind this opening, the seat for the center post is located. The position of this seat and the length of the center post determine the furthest inward position of the piston. The piston seal and spring retainer must not come into contact with each other. The post must not wedge or stick in this seat; gas pressure alone holds the two together during operation. The remainder of the passage guides the center spring post. Care should be taken that the diameter of this guide be great enough to allow unrestricted gas flow to the port. At the farthest outstroke of the piston, the spring post should not leave this guide. The elastic band retainer bracket is grooved to retain the rubber band 276. Keeping the band retainer toward the tail of the piston also reduces possible tilt; however, the venturi section of the piston is also structurally the weakest portion. A recommended position is just behind the piston port. This location gives adequate strength and also sufficient piston length to provide stability in the cylinder.

The open area between the venturi nozzle and the piston port should be of a width no greater than the corresponding slots 104 in the cylinder wall.

The venturi nozzle creates a suction to draw powder into the gas stream and also covers the slots 104 in the cylinder wall to prevent powder leakage when not in use. Several factors influence the performance of the venturi. Increasing the outlet opening diminishes the venturi effect with a resulting decrease in the amount of powder in the gas stream. The nozzle surfaces should be smooth as powder will stick to any roughened surface. It may be desirable to mold the venturi nozzle to be angled slightly out to each side. This angular molding will insure a positive covering of the slots 104 in the cylinder wall.

The elastic band 276 is preferably cut from natural rubber timing. The inside diameter is about 0.125 inches; wall thickness is about 1/16 inch; and length about 0.10 inches. Natural rubber provides the liveliest spring action and is also the lowest cost. It is also standardly available in a wide range of inside diameter and wall thicknesses.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A dry product dispenser comprising:

an overcap adapted to be attached to a propellant container which has a propellant dispensing means thereon, said overcap having a dispensing control means thereon and a product dispensing outlet port defined therein;

a product supporting means mounted in said overcap and defining a product storage area;

an actuator means mounted in said overcap and including a hollow cylindrical housing mounted on said product supporting means and having product receiving slots defined therein to receive product from said product storage means, a dispensing control means contacting means positioned on said housing to be actuated by said cap mounted dispensing control means, a propellant dispensing means actuating means positioned on said housing to actuate said propellant container propellant dispensing means, said actuator means including a spring element located in said hollow cylindrical housing and having a portion thereof movable and a post mounted on said movable portion for movement therewith, and a spring retainer mounted in said hollow cylindrical housing to limit movement of said spring movable portion, said actuator mechanism further including a piston element movably mounted in said hollow cylinder housing and having a fluid passage defined therethrough to fluidly connect said propellant dispensing means with said product receiving slots and said product dispensing outlet port defined in said overcap so that propellant dispensed from said propellant container intersects product received through said slots and passes out of the outlet port with product entrained therein, said product supporting means being located between said slots and the propellant container; and a snubber on said actuator means resisting movement of said piston relative to said hollow cylindrical housing.

2. The dry product dispenser defined in claim 1 wherein said spring element includes a disc shaped base having a plurality of sections defined therein.

3. The dry product dispenser defined in claim 2 wherein said spring retainer includes a projection contacting one of said spring sections to hold said contacted section against movement.

4. The dry product dispenser defined in claim 3 wherein said piston and spring element disc are located in said housing so that propellant forces said spring element movable portion and said piston element to move together for a predetermined amount of movement.

5. The dry product dispenser defined in claim 4 wherein said spring retainer is positioned relative to said spring so that said spring movable portion contacts said spring retainer after said predetermined amount of movement.

6. The dry product dispenser defined in claim 5 wherein said spring element post occludes said piston passage during said predetermined amount of movable portion movement and frees said passage after said predetermined amount of movement.

7. The dry product dispenser defined in claim 6 wherein said piston includes second product receiving slots which are offset from said housing product receiving slots during said predetermined movement and are aligned at the end of said predetermined movement.

8. The dry product dispenser defined in claim 7 wherein said piston includes a venturi section in fluid communication with said passage and said second product receiving slots.

9. The dry product dispenser defined in claim 8 wherein said passage includes a seating section which abuttingly receives said post during said predetermined movement.

10. The dry product dispenser defined in claim 9 wherein said product storage means includes a platform.

11. The dry product dispenser defined in claim 10 wherein said platform is dish shaped.

12. The dry product dispenser defined in claim 11 wherein said platform is removably mounted on said cap.

13. The dry product dispenser defined in claim 12 wherein said cap includes a channel in which said platform is held with said channel including an undercut portion and a ledge portion.

14. The dry product dispenser defined in claim 8 wherein said piston further includes a port means fluidly connecting said venturi section to said cap product dispensing outlet port.

15. The dry product dispenser defined in claim 1 wherein said cap located dispensing control means includes a fingerwell defined in said cap and a stepped surface located in said fingerwell.

16. The dry product dispenser defined in claim 1 wherein said snubber includes an elastic band.

17. The dry product dispenser defined in claim 1 wherein said dispensing control means includes a stem having propellant receiving slots defined therein and a propellant port fluidly connecting said propellant receiving slots with the interior of said hollow cylindrical housing.

18. The dry product dispenser defined in claim 1 wherein said dispensing control means contacting means includes a pin mounted on said housing, and said cap includes a pin locator mounted thereon to contact said pin upon actuation of said cap dispensing control means.

19. The dry product dispenser defined in claim 1 wherein said actuator means is mounted on said product storage means to vibrate said product storage means during actuation of said actuator means so that product is moved by the vibration.

20. The dry product dispenser defined in claim 1 further including a child-safety element which has a plate movably mounted on said cap and a swing arm connecting said plate to said propellant dispensing means actuating means.

21. The dry product dispenser defined in claim 20 further including a bracket on said housing located to receive said propellant dispensing means actuating means, said bracket having a first section which permits actuating of said propellant dispensing means actuating means and a second section which prevents actuation of said propellant dispensing means actuating means, said swing arm being connected to said propellant dispensing means actuating means to move same between said first and second bracket sections.

22. The dry product dispenser defined in claim 1 wherein said snubber includes a steel band.

23. The dry product dispenser defined in claim 22 wherein said steel band is located in said product storage area.

* * * * *